United States Patent [19]

Perock

[11] Patent Number: 4,756,439

[45] Date of Patent: Jul. 12, 1988

[54] CONTAINER WITH INTEGRAL WASHBOARD

[76] Inventor: Michael J. Perock, P.O. Box 3026 -- R.D. #3, Pottsville, Pa. 17901

[21] Appl. No.: 137,060

[22] Filed: Dec. 23, 1987

[51] Int. Cl.[4] ..... B65D 21/00

[52] U.S. Cl. ..... 220/83; 220/90; 15/264

[58] Field of Search ..... 220/83, 90, 72; 15/264

[56] References Cited

U.S. PATENT DOCUMENTS

| | | | |
|---|---|---|---|
| 606,295 | 8/1898 | Coatsworth . | |
| 1,987,232 | 1/1935 | Gilbert | 220/72 X |
| 2,827,648 | 3/1958 | Geisz | 220/90 X |
| 2,988,769 | 6/1961 | Tretwold et al. | 220/90 X |
| 3,671,992 | 6/1972 | Linger | 220/90 X |
| 4,083,466 | 4/1978 | McManaway | 220/90 |

*Primary Examiner*—Steven M. Pollard
*Attorney, Agent, or Firm*—Ruth Moyerman

[57] ABSTRACT

A container with an integral washboard includes at least one spout. The washboard is formed by the corrugated interior of at least one wall and a spout is formed at the top of the wall. The spout has a mouth and two sides; the sides flexing inward toward that mouth during use to provide increased scrubbing power.

6 Claims, 2 Drawing Sheets

CONTAINER WITH INTEGRAL WASHBOARD

BACKGROUND OF THE INVENTION

1. Field of the Invention

This invention relates to buckets, and more particularly to a bucket with a scrubbing surface.

2. Description of the Prior Art

Despite the many mechanical and motorized washing machines on the market, it is still sometimes necessary to wash clothing or other cloth items by hand. This is particularly true when an item has been stained. For particularly difficult stains, soaking is not enough and the item must be scrubbed by hand. To facilitate cleaning, one may use a wash board, rub the item between one's hands, or rub sections of the item against each other. Although washboards and hand rubbing are useful, those methods apply friction to only one surface of the cloth at a time and, therefore, a great deal of energy must be used to scrub, turn the material, and scrub again, perhaps multiple times. This procedure is also hard on the garment. Also, a washboard must be placed in a large sink. There is, therefore, a need for a convenient scrubbing surface which applies friction to several areas of a cloth at one time and which is integral with a basin or bucket, eliminating the need for a large sink.

SUMMARY OF THE DISCLOSURE

The aforementioned prior art problems are obviated by the container with integral washboard of this invention. A container, preferably a bucket, has at least one interior wall which is corrugated to form a washboard with a centered spout. The spout has a mouth and two sides. Because the corrugations impart flexibility to the sides, they are flexed and drawn inward toward the mouth dfuring use to provide increased scrubbing power. The container may have more than one spout and may also include a support bar to span opposing container sides to aid in flexing of the washboard. It is preferable that container be made of materials which are flexible but still sturdy, such as polypropylene or polyethylene.

It is, therefore, a primary object of this invention to provide a container with multiple washboard surfaces, all capable of simultaneous scrubbing action.

It is a further object of this invention to provide a container for washing clothes which includes an integral washboard for scrubbing.

It is another object of this invention to provide a container with an integral washboard which is supported in a base.

It is a further object of this invention to provide a container with an integral washboard spout which flexes when used.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
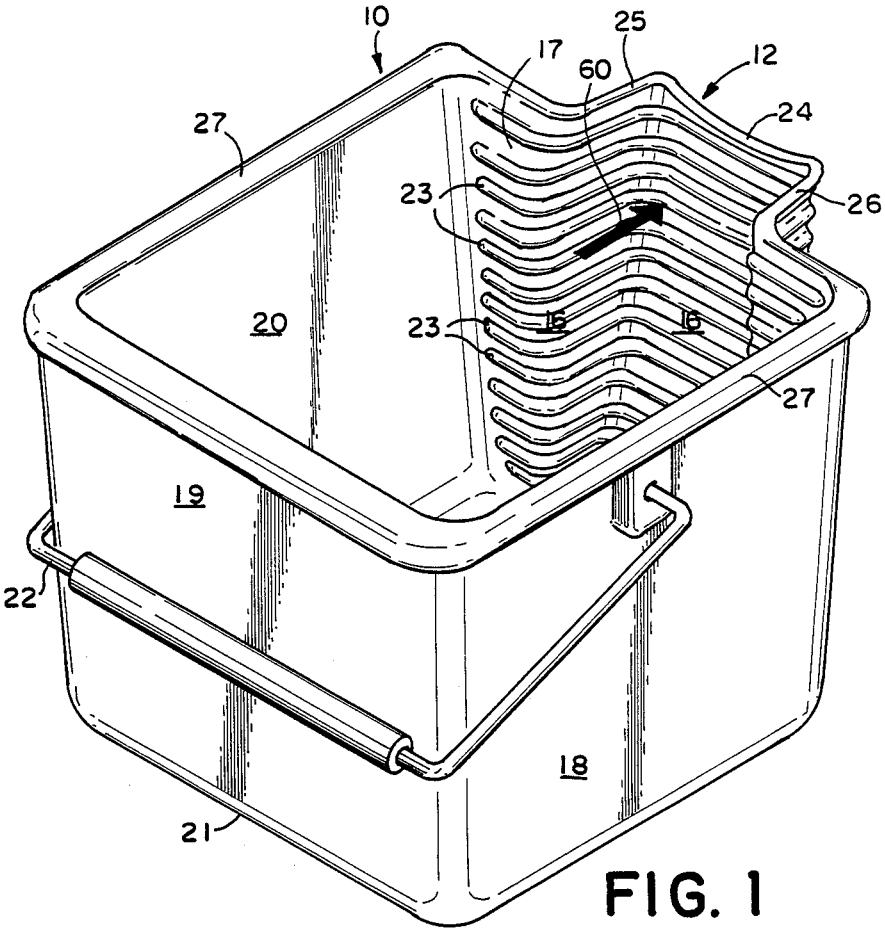
FIG. 1 is an isometric view of the preferred embodiment of this invention with one washboard spout.
Figure 2:
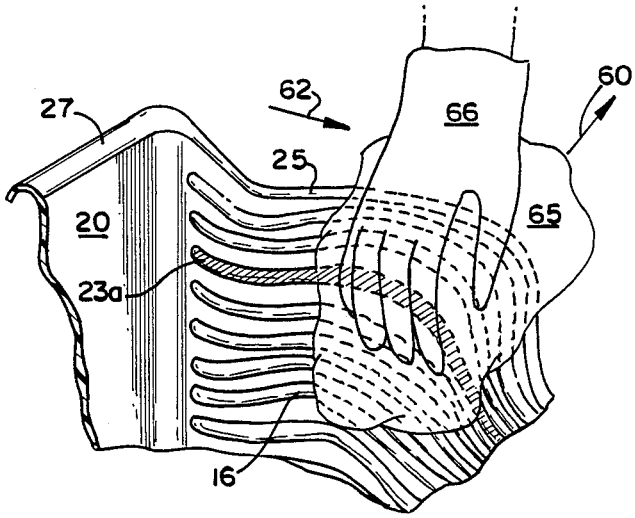
FIG. 2 is a partial enlargement of FIG. 1 illustrating the washboard spout in detail.

Referring now to the drawings, and more particularly to FIGS. 1 and 2, container 10 with integral washboard 16 is seen first in isometric view and then in partial enlargement. Container 10 is generally a bucket with handle 22, walls 17, 18, 19 and 20, and bottom 21. The open top has circumferential rim 27. Wall 17 is corrugated to produce an integral washboard 16. The corrugations are continuous for the whole width and depth of wall 17. Washboard 16 includes spout 12 which has mouth 24 and sides 25 and 26.

It is well known that when cloth has been dirtied or stained, abrasion of the cloth surface to another surface is an aid in removing the stain or dirt. In use, container 10 is filled with cleansing solution and the cloth submersed in it. The section of cloth which is stained is then rubbed against corrugations 23 on wall 17, which form the surface of washboard 16. In order to provide abrasion to a great area at one time, the cloth 65 is rubbed in spout mouth 24 by hand 66. Because washboard 16 is flexible, pressure on mouth 24 pushes spout 12 in the direction of arrows 60 and draws sides 25 and 26 in toward mouth 24, as indicated by arrows 62. As a user continues to scrub the cloth against mouth 24, he is simultaneously scrubbing against sides 25 and 26, increasing the work with no increase of effort. Because each corrugation 23 is continuous, as is illustrated by corrugation **23*a* in FIG. 2, it aids in drawing sides 25 and 26 towards mouth 24**.

It is desirable that sides 25 and 26 form an angle of about 3° with mouth 24. When such an angle is provided, the maximum flexing of sides 25 and 26 is achieved.

Also seen in FIGS. 1 and 2 is rim 27. Rim 27 is enlarged on the non-washboard walls of container 10 to make those walls more rigid and less likely to be deformed when pressure is placed against the washboard 16. Also, as will be seen in FIG. 3, it is important that rim 27 be rigid and of sufficient strength to support container 10 when it is suspended from a stand by rim 27.

Figure 3:
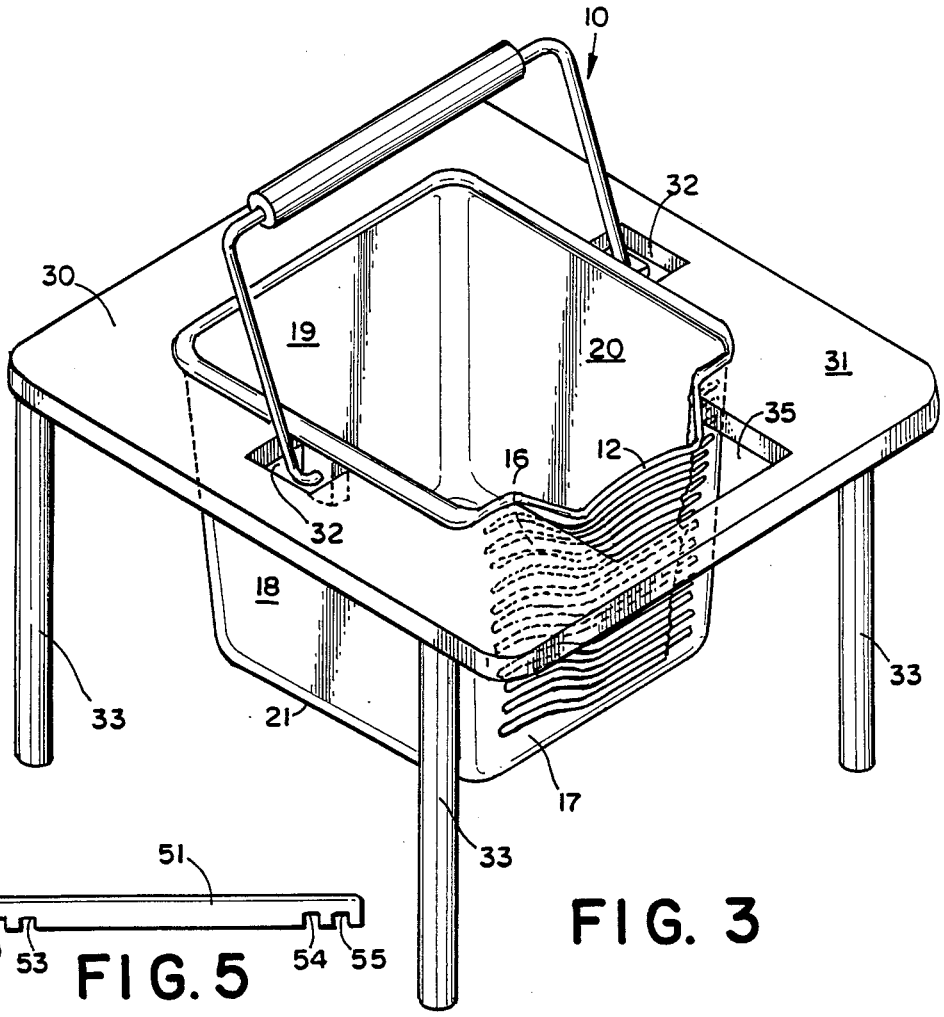
FIG. 3 is an isometric view of the preferred embodiment placed in a stand.

Now referring to FIG. 3, container 10 is seen suspended from stand 30. Container 10 is seen to have bottom 21, walls 17, 18, 19, and 20, and washboard 16 with spout 12. Stand 30 has legs 33 and top 31. Top 31 has a cut-out area 35 to accommodate spreading of spout 12 and handle cut out areas 32 for handle 22. When filled container 10 is lifted by handle 22 into stand 30, handle 22 then rests on stand top 31 out of the way during use. Stand 30 adds to the usefulness of container 10 by placing container 10 at a convenient height. Additionally, pressure of scrubbing will not move container 10 around, as might be the case if container 10 were simply placed on a table.

Figure 4:
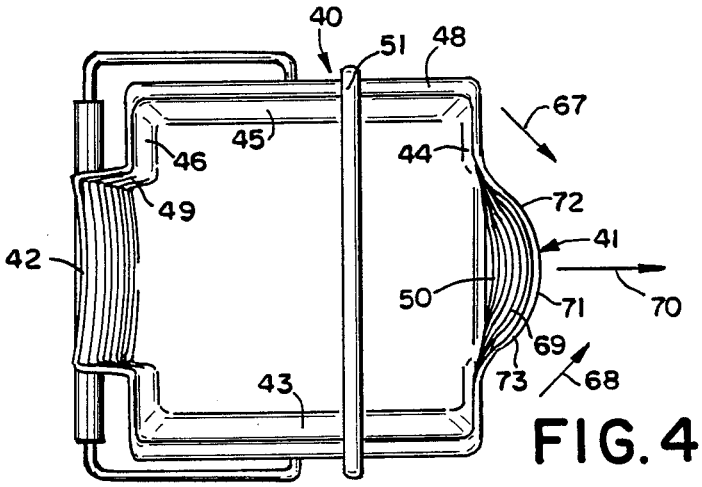
FIG. 4 is a top view of an alternative embodiment with two washboard spouts and a support bar.

Now referring to FIG. 4, bucket 40, an alternative embodiment of this invention, is illustrated. Bucket 40 has rim 48, bottom 57, and walls 43, 44, 45 and 46. Walls 44 and 46 have washboard 50 and 49, and spouts 41 and 42 respectively. Spout 41 is shown with mouth 71 and sides 72 and 73. FIG. 4 illustrates the deforming of a spout when scrubbing pressure is put upon it. Spout 41 has been pushed forward in the direction of arrow 70 by scrubbing action. As mouth 71 moves forward in the direction of arrow 70, the corrugations 69 give flexibility to sides 72 and 73, drawing them inward in the direction of arrows 67 and 68.

Also seen in FIG. 4 is support bar 51 which overfits a rim 48 on opposing side wall 43 and 45. Bar 51 draws sides 43 and 45 inward to give more flex to the sides. The closer that the bar is placed to the spout being used, the more assistance bar 51 gives to the bottom of the spout.

FIG. 4 illustrates a washboard bucket with two washboards and spouts. It is evident that the bucket may have from one to four washboards and spouts, depending on proposed use. Container 40 is a bucket with a handle, but it may be a basin with more shallow sides.

Figure 5:
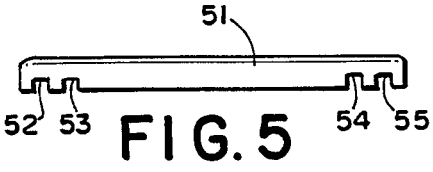
FIG. 5 is a side view of the support bar.

Now referring to FIGS. 4 and 5, support bar 51 is seen in top and side view respectively. Bar 51 is preferably an elongated rectangular bar with a set of notches on each end. Bar 51 is placed on rim 48 so that either notch 52 or 53 and either notch 54 or 55 overfits rim 48. The greatest amount of flex will be imparted to spout 41 when bar 51 is placed near to spout 41. For less flexing, bar 51 may be moved toward spout 42. Also, greater flex will be provided if notches 53 and 54 are used than if the outer notches 52 and 55 are used. Thus, it can be seen that the flexibility of the spout sides can be adjusted by both movement of bar 51 and by the notches used.

It should be understood that each embodiment described herein may be combined with each other embodiment. The container may be bucket-shaped or it may be basin-like with more shallow sides. The support bar may be used with any embodiment, as may be the stand. There may be from one to four washboard surfaces and spouts in each embodiment and still be within the scope of the invention.

It is preferred that the container be of a semi-rigid material which will flex when corrugated, for instance rubberized materials or plastic such as polypropylene or polyethylene, but other materials which offer the same flexibility and sturdiness are within the scope of this invention. Bar 51 may be metallic, plastic or wood.

There are many advantages to the container with integral washboard of this invention. Chiefly, the corrugation which produces a washboard surface inside a bucket or basin allows a user the advantage of a washboard without the inconvenience of having to place a large washboard into a large container or sink. Also, the flex in the sides of the spout produce greater scrubbing power without greater expenditure of energy on the part of the user.

Having now illustrated and described my invention, it is not intended that such description limit this invention, but rather that this invention be limited only by reasonable interpretation of the appended claims.

What is claimed is:

1. A container with integral washboard comprising a generally rigid container with four walls, a closed bottom and an open top, said top including a circumferential rim, at least one said wall being corrugated on its interior and including a flexible spout at its top, said spout having two sides and a mouth, each said side joined to said mouth to form an angle of about 3°, said mouth generally twice as long as each said side and curved toward said container's interior, so that when pressure is put upon said mouth, said spout sides are drawn toward said mouth's center.

2. The container with integral washboard according to claim 1 wherein a plurality of walls are interiorly corrugated and each includes a spout.

3. The container with integral washboard according to claim 1 wherein said corrugations are continuous the width of said wall.

4. The container with integral washboard according to claim 1 wherein said circumferential rim is thickened at said wall portions not containing said spout.

5. The container with integral washboard according to claim 1 including, additionally, a support bar sized to span opposing container sides, said bar including proximate each bar end at least one notch to overfit said rim.

6. The container with integral washboard according to claim 5 wherein said bar includes, additionally, a second notch at each bar end so that when said bar is placed onto said rim with the most interior notches overfitting said rim, said mouth is drawn inward and said sides are drawn towards said mouth.

* * * * *